US005465104A

United States Patent [19]

Munson

[11] Patent Number: 5,465,104

[45] Date of Patent: Nov. 7, 1995

[54] COLOR INFORMATION STORAGE AND PROCESSING SYSTEM

[75] Inventor: James B. Munson, Albuquerque, N.M.

[73] Assignee: Digital Equipment Corporation, Maynard, Mass.

[21] Appl. No.: 912,570

[22] Filed: Jun. 24, 1992

Related U.S. Application Data

[63] Continuation of Ser. No. 369,040, Jun. 20, 1989, abandoned.

[51] Int. Cl.[6] ..... G09G 5/00

[52] U.S. Cl. ..... 345/150; 345/153

[58] Field of Search ..... 358/16, 80; 356/405, 356/406; 340/701, 703; 395/131; 364/526; 345/150, 153

[56] References Cited

U.S. PATENT DOCUMENTS

| | | | |
|---|---|---|---|
| 4,488,245 | 12/1984 | Dalke et al. | 364/526 |
| 4,496,968 | 1/1985 | Pugsley | 358/80 |
| 4,500,972 | 2/1985 | Kuhn et al. | 364/526 |
| 4,623,973 | 11/1986 | Hoffrichter et al. | 364/526 |
| 4,648,050 | 3/1987 | Yamagami | 364/526 |
| 4,710,806 | 12/1987 | Iwai | 358/81 |
| 4,719,503 | 1/1988 | Craver et al. | 340/703 X |
| 4,805,016 | 2/1989 | Kato | 358/98 |
| 4,812,902 | 3/1989 | Fuchsberger | 358/75 |
| 4,819,077 | 4/1989 | Kikuchi et al. | 358/80 X |
| 4,884,130 | 11/1989 | Huntsman | 358/80 |

OTHER PUBLICATIONS

Harold, Richard, "Electro–Optical Instrumentation for Industrial Applications", Apr. 5–6, 1983, vol. 411, pp. 36–42 and 1 drawing.

*Primary Examiner*—Richard Hjerpe
*Attorney, Agent, or Firm*—Kenyon & Kenyon

[57] ABSTRACT

A color information storage and processing system including a converter adapted to translate red, green and blue values of a color into an achromatic dimension and two chromatic dimensions. The red, green and blue values are processed to provide chromatic dimensions which are independent from one another and completely decoupled from the achromatic dimension. The color information storage and processing system stores the achromatic and chromatic dimensions and performs image processing utilizing the stored dimensions. A decoder translates the achromatic and chromatic dimensions back into red, green and blue values for use in the operation of a color monitor.

16 Claims, 3 Drawing Sheets

COLOR INFORMATION STORAGE AND PROCESSING SYSTEM

This is a continuation of application Ser. No. 07/369,040 filed on Jun. 20, 1989, now abandoned.

FIELD OF THE INVENTION

The present invention is directed to a color information storage and processing system and, more particularly, to a system including a color information storage device coupled to a decoder operating in accordance with a linear opponent-based saturation color space.

BACKGROUND OF THE INVENTION

Many modern computer systems are provided with a color monitor to display output information such as, for example, graphic images in full color. Accordingly, it is necessary to provide a storage device to store the color information relating to the images to be displayed on the screen of the color monitor. Typically, the color monitor comprises a cathode ray tube having a screen with red, green and blue phosphors. An electron gun arrangement includes a red electron gun, a green electron gun and a blue electron gun. The electron guns are operated simultaneously to scan the screen from, for example, left to right, through a series of rows from the top of the screen to the bottom of the screen.

During the traversal of each row, the electron gun arrangement transmits a series of simultaneous red, green and blue signals to the color phosphors of the screen at a series of horizontally spaced points or locations within the particular row on the screen. Each point or location on the screen that receives one of the series of simultaneous red, green and blue signals represents a point or element of the entire image to be displayed. The color emitted by the color phosphors at any particular point or location on the screen is a function of the relative intensities of the red, green and blue signals transmitted by the electron gun arrangement to that point. As should be understood, red, green and blue are primary colors whereby any other color can be derived from a blending of red, green and blue light depending upon the relative amount of each primary color.

In order to store information relating to an image to be displayed in color, it is necessary to store color data for each of the image elements that comprise the rows of horizontal screen locations impacted by the scanning operation of the electron gun arrangement. Each image element is called a pixel and a storage device must be provided to store the color data for each pixel in an orderly manner so that the pixel data can be retrieved from the storage device and processed to control the operation of the electron gun arrangement.

Color can be regarded as a three-dimensional value, which means that three values can be used to define a particular color in a unique fashion. The above-described color monitor operates on the basis of color definition provided by the red, green and blue constituents of the color for each pixel. Accordingly, the data for each pixel can comprise a red value, a green value and a blue value.

A "color space" refers to a three-dimensional space used to define, by analogy, the three values required to represent a particular color. For example, in the operation of the electron gun arrangement of the color monitor, each color comprises a red component, a green component and a blue component. This color information can be defined in terms of an RGB (red-green-blue) space with X, Y and Z coordinates corresponding to the red, green and blue components, respectively. The X, Y and Z coordinates define a volume with any given point within the volume corresponding to a unique color represented by the red, green and blue values of the coordinates of that point.

An RGB space is a convenient color space for use in storing color information because both the electron gun arrangement and color phosphor structure of the screen operate on the basis of red, green and blue constituent signals to provide color. However, present knowledge of human physiology indicates that the human visual system processes color information in accordance with an achromatic and two chromatic dimensions. The achromatic dimension is related to the "brightness" of the color and the chromatic dimensions are separated into two so-called "opponent" chrominance dimensions: red versus green and blue versus yellow.

Thus, when color information is stored in accordance with an RGB space definition of color, any processing modifications to the values of the red, green and blue components to, for example, adjust the color image on the monitor screen will not be of a high perceptual quality to a human user. Accordingly, it has been recognized that it would be desirable to store color information in accordance with achromatic and chromatic dimensions and to process the achromatic dimension separately from the chromatic dimensions to provide image processing that more closely coincides with the fundmental color processing mechanisms of human perception.

One known color space that is based upon achromatic and chromatic dimensions (generally referred to as a luminance-chrominance space or $LC^2$ space) is the HLS space, wherein H stands for hue, L stands for luminance and S stands for saturation. The HLS space is represented by polar coordinates i.e. a magnitude and an angle relative to the X, Y, Z coordinates. L is defined by the formula L=(min RGB+max RGB)/2. The hue and saturation components, H and S, are determined in a chrominance plane which lies at a fixed value of L, e.g., L=½. Chrominance is defined in terms of the hue and saturation magnitude. The hue is represented by an angle, the hue angle, and is cyclic, running from 0° to 360° as color changes from blue to green to yellow to orange to red to purple and back to blue again. The saturation magnitude corresponds to the length of the line defined by the hue angle and varies from zero, meaning gray regardless of hue angle, to unity or saturation, meaning a pure hue, as defined by the particular hue angle, with no admixture of white.

In an RGB to HLS translation, the R,G,B values for a given color are scaled up or down to determine the red, green and blue values at L=½. The functions used to calculate H and S depend upon the relative sizes of the scaled red, green and blue components. For example, if the red component of a particular color is the largest and the blue component is the smallest, then the particular color lies somewhere in the area between red, yellow and gray. In this instance, S=R−B and H=60° * (G−B)/(R−B). Similar formulas can be derived to provide S and H values for all other relative sizes of the red, green and blue components for all of the colors within the visual color spectrum. To reverse the computation, i.e., a calculation of RGB values to operate the electron gun arrangement from stored HLS values, the formula for S and H would be inverted to provide RGB values at L=½ and the calculated RGB values would be scaled up or down to provide the RGB values at the actual L value of the color to be displayed.

While an HLS space provides achromatic and chromatic components, a major disadvantage is that the hue and saturation chrominance components are not independent from one another, particularly in terms of the opponent red-green and blue-yellow chrominance dimensions used in the human visual system. In addition, the polar coordinate system used to define the HLS space is not linear and involves a high degree of complexity in the computations required for RGB to HLS and HLS to RGB translations.

To reduce computational complexity, a linear space is preferred. A linear space is one in which the computations required to translate to or from RGB values only involve multiplication by fixed coefficients and addition. The American television industry has adapted a standard linear color space, called a YIQ space, for use in processing color signals. Y corresponds to genuine luminance, and is a function of the relative luminosity of each of the color phosphors used in the television screen. The I and Q components are selected to provide some compression of chrominance values into separate color space components without affecting flesh tones, which, in the context of the television industry, are considered critical to apparent color quality. In addition, for compatibility with existing black and white television sets, the Y signal is selected so that the Y signal alone could be used for black and white broadcasts.

With the advent of digital high-definition color television, the television industry has adapted another linear color space referred to as a YUV space, wherein Y corresponds to the genuine luminance value used in the YIQ space and the U and V components lie at approximately 45° angles to the I and Q components and closely approximate the red/green and blue/yellow opponent chrominance dimensions of the human visual system. More precisely, the U and V components correspond to (red—luminance) and (blue—luminance) values, respectively.

A disadvantage of the YIQ and YUV color spaces, as well as linear spaces in general, is that the chromatic dimensions are not completely decoupled from the achromatic dimension, as would be necessary to accurately approximate human physiology. This is due to the rectangular relationship between the achromatic and chromatic coordinates of the linearly tranformed color space as directly derived from the rectangular RGB coordinates of the RGB space.

Another disadvantage of any linear color space that is derived directly from an RGB space is that, in geometric terms, the linear transformation takes the rectangular box defined by the RGB coordinates and places it within a superimposed rectangular box defined by the new linear space. Due to the linear coefficient multiplication and addition required to achieve the transformation, the rectangular box defined by the new linear space would be disposed at an angular relation to the RGB rectangular box and would have to be of larger dimensions so as to completely enclose the RGB rectangular box.

The new rectangular box would have to enclose completely the RGB rectangular box inasmuch as each and every color value defined by all of the points within the RGB color space must also lie within the new color space to enable a complete transformation between the color spaces. Accordingly, there would be a great many points within the larger rectangular box that do not also lie within the RGB rectangular box. In physical terms, this means that many colors which can be described in, for example, YUV or YIQ space are not actually displayable by the RGB electron gun arrangement. Thus, much of a linear space is wasted and will never be used. Indeed, it has been determined that up to 50% of a linear space directly derived from an RGB space may be unusable.

A practical consequence of the larger dimensions of the transformed linear space is that each point may require a greater number of bits to uniquely define the point within the transformed space, relative to the number of bits needed to uniquely define the point within the smaller RGB space. The extra bits take up memory space and use excessive bandwidth during data transmissions.

Another consequence is that upon processing of the transformed values, these values may be projected into those portions of the larger rectangular box outside the RGB rectangular box and therefore define a point which is not translatable back into displayable RGB values.

Accordingly, each of the heretofore known color spaces have inherent disadvantages which preclude an efficient linear transformation from and into RGB values using an achromatic dimension and pure and independent chromatic dimensions which are completely decoupled from the achromatic dimension and which can be defined to coincide with the opponent red-green and blue-yellow chrominance dimensions of the human visual system.

SUMMARY OF THE INVENTION

The present invention provides a color information storage and processing system that operates to translate and store color information in a linear color space having two chrominance components that are completely decoupled from an achromatic component and wherein the chrominance components are independent of one another. In addition, the color space of the present invention permits the two chrominance components to be defined to coincide with the red-green and blue-yellow chrominance components, respectively, of the human visual system to provide high quality color processing.

Generally, the color space of the present invention can be represented, in geometric terms, as a space defined by a double pyramid with the common axis of the double pyramid, referred to as the L axis, defining the achromatic component of the color space. The achromatic component, in terms of color, varies from black (a minimum value), at the point of the lower pyramid of the double pyramid space to gray, at the center of the plane defined by the common base of the two pyramids of the double pyramid space, to white, (a maximum value), at the point of the upper pyramid of the double pyramid space.

For ease of computation and linearity, all chrominance component values are mapped at a preselected chrominance plane that preferably corresponds to the common base of the double pyramid space, wherein L is defined as L= ½ . (It should be noted that throughout this description, all values are indicated in terms of zero to unity (0 to 1) indicating a maximum value for the component at 1 and a minimum value at 0.)

Pursuant to the invention, the chrominance plane at, e.g., L=½ is mapped in relation to an S axis and a T axis wherein S and T are rectangular coordinates (i.e. 90° apart) to define two chrominance dimensions which are completely independent of one another. Moreover, the minimum and maximum values for each of S and T are defined in terms of opposed sets of pure red, green and blue values and/or combinations of these pure values for pure chrominance value boundaries for the plane defined by the S-T axes. Pure is defined as the value of the chrominance value being equal to unity at the boundary.

In addition, the S and T components are preferably defined such that the maximum value of S equals pure red and the minumum value of S equals pure green while the maximum value of T equals pure blue and the minimum value of T equals pure yellow (the sum of pure red and pure green). Thus, the S and T values are rectangular with respect to one another for independence and correspond to both the monitor colors and the opposed red/green and blue/yellow chrominance dimensions significant to human color processing. Moreover, the use of RGB boundaries for the plane defined by the S and T axes provides an S-T chrominance plane that coincides with an RGB plane at L=½. Thus, all of the points within the S-T plane are usable for translation into displayable RGB values.

If S and T are at their maximum value simultaneously, the color is magenta, while a maximum S and minimum T results in the color orange, minimum S and maximum T results in cyan and minimum values for both S and T results in chartreuse. The S-T plane, as defined above, is a square when all values are represented by zero to unity corresponding, respectively, to minimum to maximum values.

In the S-T chrominance plane, the red, green and blue components of a particular color are normalized to corresponding red, green and blue values at an achromatic value of L=½ and then translated into S and T components. A decoder operates pursuant to a mathematical model to perform ST to RGB and RGB to ST translations. The mathematical model is derived to represent the S-T plane in accordance with eight sectors of the plane defined in terms of relative normalized red, green and blue values and a series of RGB to ST and ST to RGB linear translations for each sector.

In this manner, the linearity preferable for fast and efficient translation is obtained with chrominance components, S and T, that are independent of one another and entirely decoupled from the achromatic component. In an LST to RGB translation, the S and T values are translated to red, green and blue values at L=½ and then these values are un-normalized to red, green and blue values at the actual brightness of the color.

In order to further coincide with the human visual system, the achromatic component, L, used in the present invention, is preferably calculated with reference to the "brightness" or "lightness" of the color. For example, the achromatic component L of the HLS space can be used. In the previously adapted YIQ and YUV television standards, the Y achromatic component corresponds to a pure luminance value based upon the luminosity of the color phosphors of the television screen. The L value of the HLS color space, on the other hand, corresponds more closely to the apparent brightness of the color, which is not necessarily directly related to luminance. It appears that the human visual system processes color on the basis of brightness rather than pure luminance. Indeed, the luminance reference values used in previous linear color spaces, such as the YIQ and YUV spaces, are related to the luminance of the color monitor, which is a physical property of the color phosphors used in the screen and, thus, not related to human achromatic dimension processing.

Thus, the present invention provides color information having data values that can be processed in a manner that is consistent with human color processing mechanisms for high quality color image processing. The color information storage and processing system includes a processing device for image processing color information stored in terms of LST values. An LST frame buffer is also provided to store the processed LST color values for each of the pixels of an entire image to be displayed on a color monitor. The LST-to-RGB decoder couples the LST frame buffer to an RGB monitor and operates to translate LST values to corresponding RGB values in accordance with sector, translation and unnormalizing information that correlates the stored LST values to the corresponding RGB values required to operate the electron gun arrangement of the color monitor.

DETAILED DESCRIPTION

Figure 1:
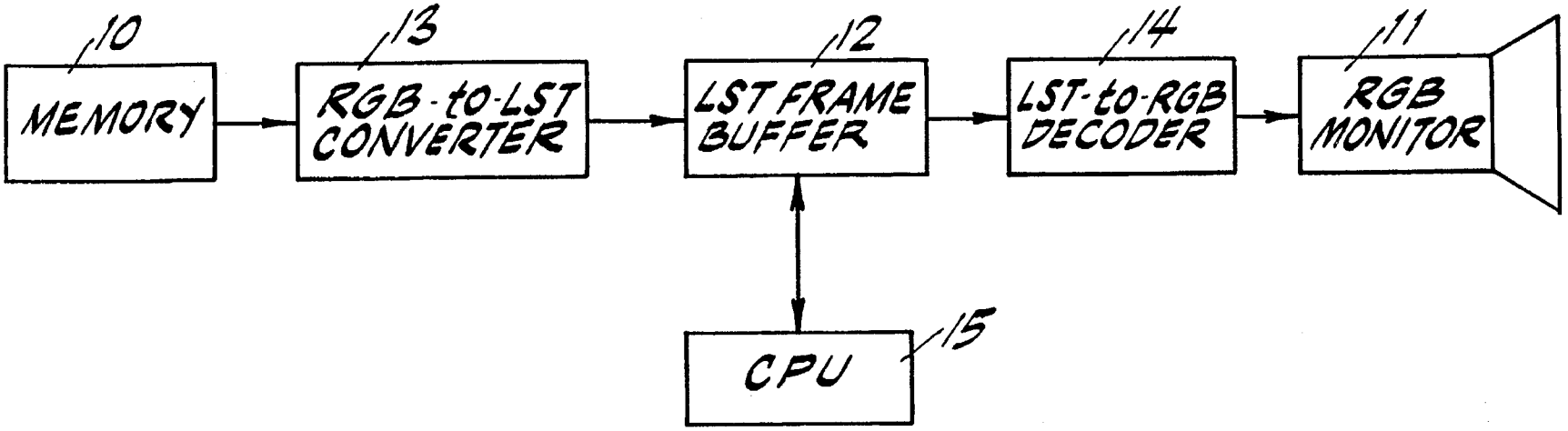
FIG. 1 is a block diagram of a color information storage and processing system in accordance with the present invention.

Referring now to the drawings, and initially to FIG. 1, there is illustrated in block diagram form, a color information storage and processing system. A memory 10 stores color graphics information for the pixels of the images to be displayed on a color monitor 11. The color graphics information stored in the memory 10 may be defined in terms of RGB values to control the operation of a red-green-blue electron gun arrangement within the color monitor 11, as is well known.

Pursuant to the invention, the color graphics information for an entire image to be displayed is stored in an LST frame buffer 12 that stores the graphic information in terms of LST values for image processing, as will be described in greater detail below. An RGB-to-LST converter 13 couples the memory 10 to the LST frame buffer 12 to convert the RGB values of the color data for the pixels of the image to be displayed into corresponding LST values. Moreover, an LST-to-RGB decoder 14 couples the LST frame buffer 12 to the color monitor 11 to convert the LST values back into RGB values, as needed for display on the color monitor 11.

An image processing device, such as a central processing unit 15, is coupled to the LST frame buffer for image processing. The central processing unit 15 operates to perform various image-related operations on the LST data such as picture enhancement, rendering of graphics images and compression. As discussed above, the LST values correspond to the color dimensions utilized in human color processing mechanisms and, thus, enable the central processing unit 15 to provide high quality color processing in a manner that is directly meaningful to human perception.

Figure 2:
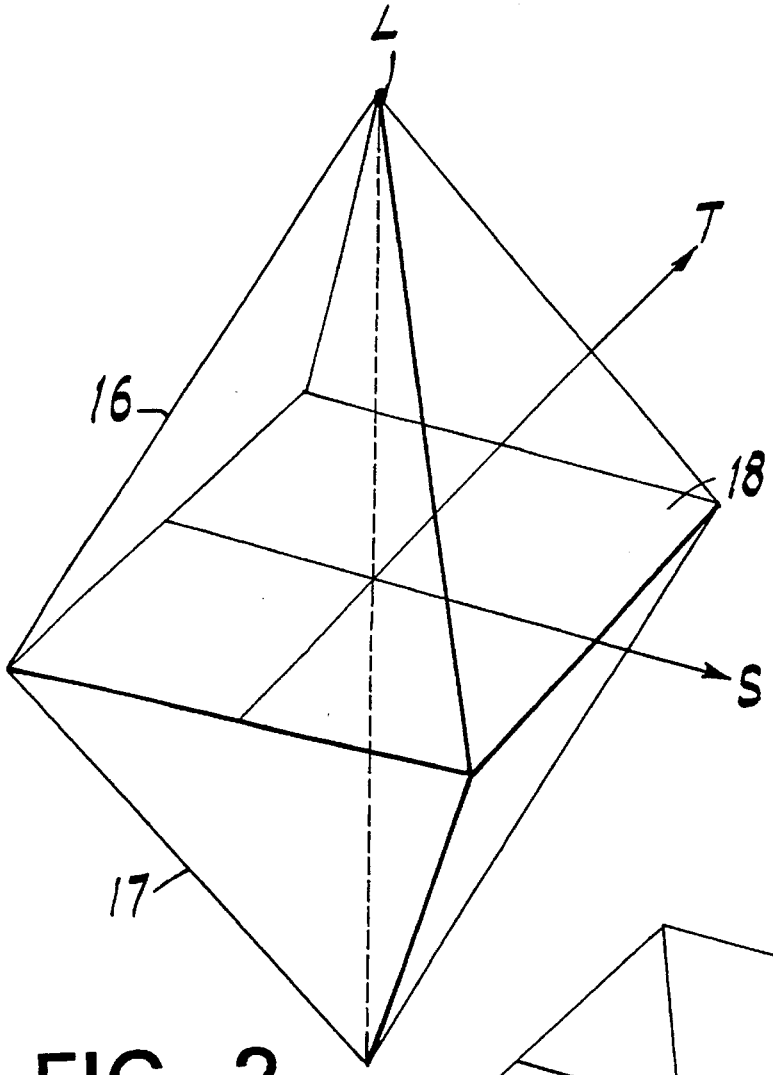
FIG. 2 is a geometric representation of an LST color space used to define color values for storage and processing in the color information storage and processing system of FIG. 1.

Referring now to FIG. 2, there is illustrated a double pyramid that represents the color space defined by the LST values of the present invention. Each point within the double pyramid space uniquely defines a particular color. All of the points of the double pyramid space cover every color that is displayable in terms of red, green and blue values. The common axis L of the upper and lower pyramids 16, 17 correspond to the achromatic or "brightness" dimension of the color. The value of a particular color's brightness in terms of RGB values is defined as: L=(min (RGB)+max (RGB))/2 wherein: min (RGB) is the smallest value among the red, green or blue constitutents of the particular color and max (RGB) is the largest value among the red, green or blue constituents of the particular color.

The midpoint, A, of the axis L is at the point of L=½. The point A is within a plane that contains the common base 18 of the pyramids 16, 17. For ease of computation, the chrominance components for all colors within the LST space are defined in relation to points within the common base 18, which requires the red, green and blue components of a particular color to be normalized to scaled up or scaled down values at L= ½ to thereby provide a corresponding RGB point that lies within the common base 18.

When the actual value of L for a particular color is less than ½ then:

| | |
|---|---|
| normalized red = | R * 1/2L |
| normalized green = | G * 1/2L |
| normalized blue = | B * 1/2L |

When the actual value of L for a particular color is greater than ½, then:

| | |
|---|---|
| normalized red = | 1 − R * 1/(2 * (1 − L)) |
| normalized green = | 1 − G * 1/(2 * (1 − L)) |
| normalized blue = | 1 − B * 1/(2 * (1 − L)) |

The two chrominance components of a color within the LST color space are defined by the S and T axes, respectively, which extend within the common base 18 at L=½. As illustrated in FIG. 2, the S and T axes extend at a 90° angle relative to one another to provide two chrominance components that are geometrically independent from one another.

Figure 3:
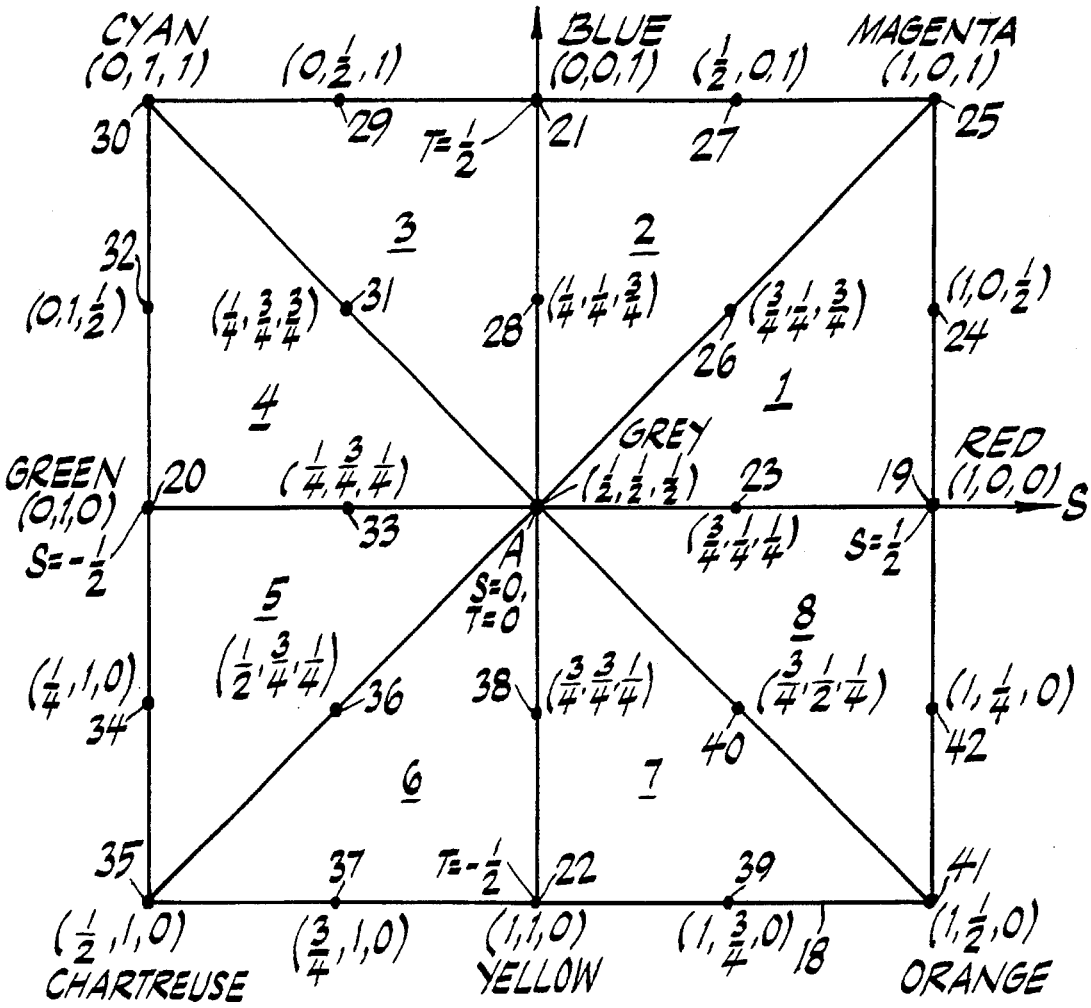
FIG. 3 is an illustration of the S-T chrominance plane of the LST color space of FIG. 2.

FIG. 3 is a plan view of the common base 18, including the S and T axes. In order to enable a linear transformation from RGB values to S and T values, and vice versa, the common base 18 is bounded by opposed sets of pure red, green, blue and yellow (yellow being the sum of pure red and pure green) boundaries such that S maximum 19 equals pure red, (RGB)=(1, 0, 0) and S minimum 20 equals pure green, (RGB)=(0, 1, 0) while T maximum 21 equals pure blue, (RGB)=(0, 0, 1) and T minimum 22 equals pure yellow, (RGB)=(1, 1, 0).

The line defined by S minimum to S maximum ranges from −½ to ½ as green progressively decreases linearly from unity to zero and red progressively increases linearly from zero to unity at T=0 (the line defined by points 20, A, 19).

The line defined by T minimum to T maximum ranges from −½ to ½ as yellow progressively decreases linearly from unity to zero and blue progressively increases linearly from zero to unity at S=0 (the line defined by points 22, A, 21).

The S-T plane is located at L=½ so that the center point of the common base 18, S=0 and T=0, corresponds to grey, RGB=(½, ½, ½). Thus, there is a blue component in each of the colors represented by the points along the S axis from S minimum to S maximum (20, A, 19). The blue component increases linearly from 0 to ½ from point 20 to point A and decreases linearly from ½ to 0 from point A to point 20, all at T=0.

Moreover, the common base 18 is further defined such that the corner point 30, at S minimum and T maximum, corresponds to cyan RGB=(0, 1, 1); the corner point 25, at S maximum and T maximum, corresponds to magenta, RGB=(1, 0, 1); the corner point 41, at S maximum and T minimum, corresponds to orange, RGB=(1, ½, 0) and the corner point 35, at S minimum and T minimum, corresponds to chartreuse, RGB=(½, 1, 0).

A series of RGB to ST linear translations and ST to RGB linear translations can be derived for the S-T chrominance plane provided by the above-described common base 18 as defined by the pure color boundaries and the S and T axes. The translations depend upon the relative values of the normalized red, green and blue values of a particular point. The relative RGB values are grouped into eight equal size triangular sectors of the common base 18:

| Sector | Line Boundaries | Relative RGB Values | Relative S-T Values |
|---|---|---|---|
| 1 | (A, 23, 19)-(19, 24, 25)-(A, 26, 25) | R>B>GG | S>T>0 |
| 2 | (A, 26, 25)-(21, 27, 25)-(A, 28, 21) | B>R>G | T>S>0 |
| 3 | (A, 28, 21)-(21, 29, 30)-(A, 31, 30) | B>G>R | T>−S>0 |
| 4 | (A, 31, 30)-(30, 32, 20)-(A, 33, 20) | G>B>R | −S>T>0 |
| 5 | (A, 33, 20)-(20, 34, 35)-(A, 36, 35) | G>1/2>R>B | −S>−T>0 |
| 6 | (A, 36, 35)-(35, 37, 22)-(A, 38, 22) | G>R>1/2>B | −T>−S>0 |
| 7 | (A, 38, 22)-(22, 39, 41)-(A, 40, 41) | R>G>1/2>B | −T>S>0 |
| 8 | (A, 40, 41)-(19, 42, 41)-(A, 23, 19) | R>1/2>G>B | S>−T>0 |

Each point illustrated in FIG. 3 includes the (RGB) values for that point. The line boundaries are described by reference to three points (see FIG. 3).

The normalized RGB to ST linear translations, by sector, are:

| | |
|---|---|
| Sector 1: | S = R − 1/2<br>T = (B−G)/2 |
| Sector 2: | S = (R−G)/2<br>T = B − 1/2 |
| Sector 3: | S = (R−G)/2<br>T = B − 1/2 |
| Sector 4: | S = R − 1/2<br>T = (B−R)/2 |
| Sector 5: | S = B − 1/2<br>T = B − R |
| Sector 6: | S = R−G<br>T = B − 1/2 |
| Sector 7: | S = R−G<br>T = B − 1/2 |
| Sector 8: | S = R − 1/2<br>T = B−G |

The S-T to normalized RGB linear translations, by sector, are:

| | |
|---|---|
| Sector 1: | R = 1/2 + S<br>G = 1/2 − S<br>B = 1/2 − S + 2T |

-continued

| | |
|---|---|
| Sector 2: | R = 1/2 − T + 2S |
| | G = 1/2 − T |
| | B = 1/2 + T |
| Sector 3: | R = 1/2 − T |
| | G = 1/2 − T − 2S |
| | B = 1/2 + T |
| Sector 4: | R = 1/2 + S |
| | G = 1/2 − S |
| | B = 1/2 + S + 2T |
| Sector 5: | R = 1/2 + S − T |
| | G = 1/2 − S |
| | B = 1/2 + S |
| Sector 6: | R = 1/2 − T + S |
| | G = 1/2 − T |
| | B = 1/2 + T |
| Sector 7: | R = 1/2 − T |
| | G = 1/2 − T − S |
| | B = 1/2 + T |
| Sector 8: | R = 1/2 + S |
| | G = 1/2 − S − T |
| | B = 1/2 − S |

The RGB values determined by the above S-T to RGB translations are normalized values at L=½. The actual RGB values must be un-normalized to the RGB values at the actual value of L for the color, as follows:

```
if L<1/2 then:
    actual R = normalized R * 2L
    actual G = normalized G * 2L
    actual B = normalized B * 2L
if L>1/2 then:
    actual R = 1 − 2 * (1−L) * (1 − normalized R)
    actual G = 1 − 2 * (1−L) * (1 − normalized G)
    actual B = 1 − 2 * (1−L) * (1 − normalized B)
```

The value of L stored with the LST values for each pixel is the L value of the actual color.

The RGB-to-LST converter 13 operates to receive from the memory 10 the RGB data for each pixel of an image to be displayed on the monitor screen. The RGB-to-LST converter 13 processes the RGB values for each pixel to provide corresponding LST output signals for each pixel. The LST output signals are input to the LST frame buffer 12 for storage of the LST values for each pixel. The RGB-to-LST converter 13 can be a processor operating pursuant to the following pseudo-code to achieve the RGB to LST conversions in accordance with the RGB and S-T value relationships of the S-T chrominance plane defined by the common base 18:

```
[RGB to LST]
    [ Calculate "lightness" ]
      L : = 1/2 * ( max (R,G,B) + min (R,G,B) )
    [ Take care of Black and White cases. ]
      if (L = 0) or (L = 1) then
        S := 0;
        T := 0;
        return;
    [ Otherwise, normalize onto L = 1/2 plane to figure
chrominance.]
      if (0 < L < 1/2) then
          scr := 1/2 / L
          R := scr * R
          G := scr * G
          B := scr * B
      if (1/2 < L < 1) then
          scr := 1/2 / (1 − L)
```

-continued

```
          R := 1 − scr * (1 − R)
          G := 1 − scr * (1 − G)
          B := 1 − scr * (1 − B)
    [ Where in the chrominance plane are we? ]
      if (R>G) then                                  [1,2,7,8]
        if (B>G) then                                [1,2]
          if (R>B) then      sector := 1
          else               sector := 2
        else                                         [7,8]
          if (G>1/2) then    sector := 7
          else               sector := 8
      else                                           [3,4,5,6]
        if (B>R) then                                [3,4]
          if (B>G) then      sector := 3
          else               sector : = 4
        else                                         [5,6]
          if (R>1/2) then    sector := 6
          else               sector := 5
case sector of
    1 :   S := R − 1/2
          T := (B − G) / 2
    2 :   S := (R−G) / 2
          T := B − 1/2
    3 :   S := (R−G) / 2
          T := B − 1/2
    4 :   S := R − 1/2
          T := (B − R) / 2
    5 :   S := B − 1/2
          T := B − R
    6 :   S := R−G
          T := B − 1/2
    7 :   S := R−G
          T := B − 1/2
    8 :   S := R − 1/2
          T := B − G
    end;
```

After processing of the LST values by the central processing unit 15, the LST-to-RGB decoder 14 operates to translate the stored LST values for each pixel, as required to operate the electron gun arrangement of the RGB monitor 11. The LST-to-RGB decoder 14 can be a processor operating pursuant to the following pseudo-code to achieve the LST to RGB translations:

```
[LST TO RGB]
[ Where in the chrominance plane are we? ]
    if (S>0) then                  [1,2,7,8]
      if (T>0) then                [1,2]
          if [+S>+T) then        sector := 1
          else                   sector := 2
      else                         [7,8]
        if (−T>+S) then          sector := 7
        else                     sector := 8
      else                         [3,4,5,6]
        if (T>0) then              [3,4]
          if (+T>−S) then        sector := 3
          else                   sector := 4
        else                       [5,6]
          if (−S>−T) then        sector := 5
          else                   sector := 6
[Calculate what RGB would be if the lightness were 1/2.]
    case sector of
        1 :  R := 1/2 + S
             G := 1/2 − S
             B := 1/2 − S + 2T
        2 :  R := 1/2 − T + 2S
             G := 1/2 − T
             B := 1/2 + T
        3 :  R := 1/2 − T
             G := 1/2 − T − 2S
             B := 1/2 + T
        4 :  R := 1/2 + S
             G := 1/2 − S
```

-continued

```
        B := 1/2 + S + 2T
[Now un-normalize from L=1/2 plane to actual L.]
    if (L < 1/2) then
      scr := 2 * L
      R := scr * R
      G := scr * G
      B := scr * B
    if (L>1/2) then
      scr := 2 * (1–L)
      R := 1 – scr * (1 – R)
      G := 1 – scr * (1 – G)
      B := 1 – scr * (1 – B)
      end;
```

Figure 4:
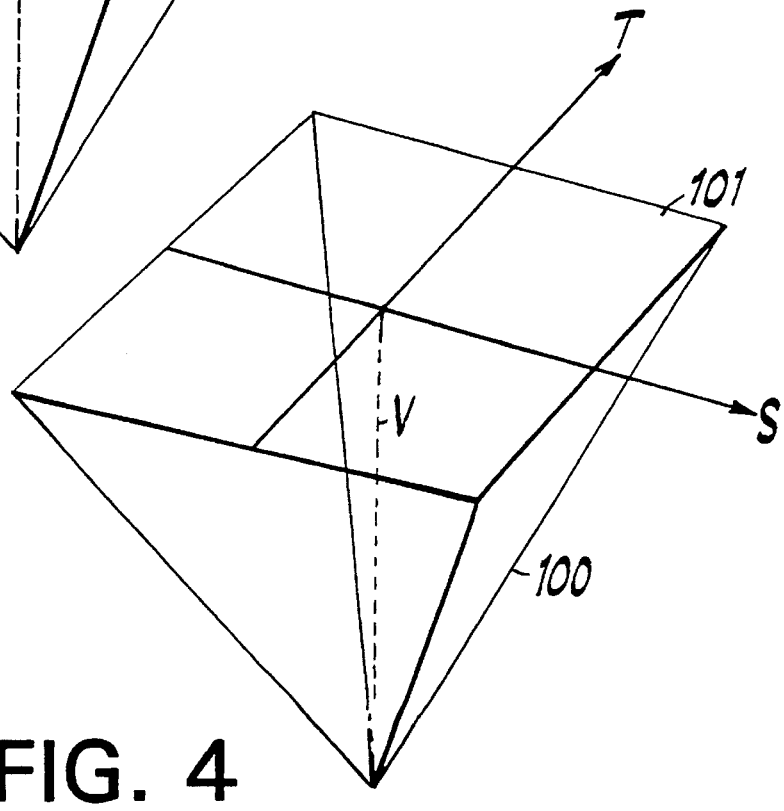
FIG. 4 is a geometric representation of a color space pursuant to another embodiment of the present invention.

Referring now to FIG. 4, there is illustrated another embodiment of a color space according to the present invention, which is designated a VST space. The VST space is represented, in geometric terms, as an inverted pyramid 100 with the achromatic component corresponding to the axis, V, of the inverted pyramid 100. V is a measure of the brightness and is defined as: V=max (RGB) wherein max (RGB) equals the maximum value among R, G, or B. The S-T chrominance plane is defined to be the base 101 of the inverted pyramid 100 at V=1. The S-T chrominance plane of the VST space is similar to the S-T chrominance plane of the LST space with the RGB to VST and VST to RGB translations slightly altered due to the use of V=1 rather than L=½ as the achromatic reference value. For example, the eight sectors of the S-T chrominance plane of the VST space are defined, as follows:

| Sector | RGB Relative Values | S-T Relative Values |
|---|---|---|
| 1 | 1 = R>B>G | S>T>0 |
| 2 | 1 = B>R>G | T>S>0 |
| 3 | 1 = B>G>R | T>–S>0 |
| 4 | 1 = G>B>R | –S>T>0 |
| 5 | G = 1, 1 + B>2R | –S>–T>0 |
| 6 | G = 1, 1 + B<2R | –T>–S>0 |
| 7 | R = 1, 1 + B<2G | –T>S>0 |
| 8 | R = 1, 1 + B>2G | S>–T>0 |

In order to provide an RGB to S-T linear translation, the RGB values must be scaled up to corresponding RGB values at V=1 to define a corresponding RGB point on the S-T plane, as follows:

V=max (RGB)

scaled up R=R/V scaled up G=G/V scaled up B=B/V

The scaled up RGB to S-T translations, by sector are defined, as follows:

| | |
|---|---|
| sector 1: | S = 1/2 (1-G) |
| | T = 1/2 (B-G) |
| sector 2: | S = 1/2 (R-G) |
| | T = 1/2 (1-G) |
| sector 3: | S = 1/2 (R-G) |
| | T = 1/2 (1-R) |
| sector 4: | S = 1/2 (R-1) |
| | T = 1/2 (B–R) |
| sector 5: | S = 1/2 (B–1) |
| | T = B–R |
| sector 6: | S = R – 1 |
| | T = 1/2 (B–1) |
| sector 7: | S = 1-G |
| | T = 1/2(B–1) |
| sector 8: | S = 1/2(1-B) |
| | T = B–G |

The S-T to scaled up RGB linear translations, by sector, are:

| | |
|---|---|
| sector 1 : | R = 1 |
| | G = 1 – 2S |
| | B = 2T – 2S + 1 |
| sector 2 : | R = 2S – 2T + 1 |
| | G = 1 – 2T |
| | B = 1 |
| sector 3 : | R = 1 – 2T |
| | G = 1 – 2S – 2T |
| | B = 1 |
| sector 4 : | R = 1 + 2S |
| | G = 1 |
| | B = 1 + 2S + 2T |
| sector 5 : | R = 1 + 2S – T |
| | G = 1 |
| | B = 1 + 2S |
| sector 6 : | R = 1 + S |
| | G = 1 |
| | B = 1 + 2T |
| sector 7 : | R = 1 |
| | G = 1 – S |
| | T = 1 + 2T |
| sector 8 : | R = 1 |
| | G = 1 –2S – T |
| | B = 1 – 2S |

The scaled up RGB values must then be scaled down to the RGB values at the actual value of V for the particular color, wherein:

```
actual R = scaled up R * V
actual G = scaled up G * V
actual B = scaled up B * V
```

The operation of each of the RGB-to-LST converter 13 and LST-to-RGB decoder 14 of FIG. 1 would be modified to implement pseudo-code based upon the above RGB to VST and VST to RGB translations. For example, the LST-to-RGB decoder 14 could operate, as follows:

```
[ Where in the chrominance plane are we? ]
    if (S>0) then
      if (T>0) then
        if (+S>+T) then          sector := 1
          else                   sector := 2
      else
        if (–T>+S) then          sector := 7
        else                     sector := 8
    else
      if (T>0) then
          if (+T>–S) then        sector := 3
          else                   sector := 4
      else
          if (–S>–T) then        sector := 5
          else                   sector := 6
[ Calculate what RGB would be if the value V were 1.)
    1 :     R := 1;
            G := 1 – 2S;
            B := 1 – 2S + 2T;
    2 :     R := 1 + 2S – 2T;
```

-continued

```
        G := 1 - 2T;
        B := 1;
3 :     R := 1 - 2T;
        G := 1 - 2S - 2T;
        B := 1;
4 :     R := 1 + 2S;
        G := 1;
        B := 1 + 2S + 2T;
5 :     R: = 1 + 2S - T;
        G := 1;
        B := 1 + 2S;
6 :     R := 1 + S;
        G := 1;
        B := 1 + 2T;
7 :     R := 1;
        G := 1 - S;
        B := 1 + 2T;
8 :     R := 1;
        G := 1 - 2S - T;
        B := 1 - 2S;
end;    [case]
[ Now unnormalize from V=1 plane to actual V. ]
    if (v < 1) then
        begin
        scr     := v;
        r       := scr * R;
        g       := scr * B;
        b       := scr * B;
        end;
```

The VST color space provides a more straightforward processing operation than the LST color space in that there is no need to make a logic determination in the scaling step. More specifically, in the VST color space, the red, green and blue value are always scaled up to the V=1 plane. In the LST color space, it must first be determined whether L is greater than or less than ½ and the red, green and blue values are then either scaled up or scaled down depending on the value of L as determined in relation to ½. Moreover, the VST color space is particularly suited for use in brightness processing of a color image. In the VST color space, all colors go toward saturation as the brightness is increased, i.e. as the color brightness approachs V=1. In the LST color space, all colors tend toward white as L approaches unity.

The achromatic and chromatic values stored in the LST frame buffer 12 and made available for processing provide a basis for high quality color image processing in accordance with color dimensions that are meaningful to human visual perception.

The above description of the present invention is meant to be representative only as certain changes may be made in the described embodiments of the invention without departing from the true scope of the invention. Accordingly, reference should be made to the following appended claims which alone define the present invention.

I claim:

1. A method of controlling a color monitor using color information, comprising the steps of:

providing a first dimension which is representative of an achromatic dimension of the color information;

deriving an achromatic value representative of the color information as a function of the achromatic dimension;

providing second and third dimensions which are representative of chromatic dimensions of the color information;

the second dimension being derived from a first set of opposed chrominance values wherein a first chrominance value of the first set varies linearly from unity to zero and a second chrominance value of the first set varies linearly from zero to unity as the second dimension increases from a minimum value to a maximum value;

the third dimension being derived from a second set of opposed chrominance values wherein a third chrominance value of the second set varies linearly from unity to zero and a fourth chrominance value of the second set varies linearly from zero to unity as the third dimension increases from a minimum value to a maximum value;

providing four corner point color values wherein: a first corner point color value corresponds to a first preselected unique color value when each of the second and third dimensions are at their respective minimum value;

a second corner point color value corresponds to a second preselected unique color value when each of the second and third dimensions are at their respective maximum values;

a third corner point color value corresponds to a third preselected unique color value when the second dimension is at its maximum value and the third dimension is at its minimum value;

a fourth corner point value corresponds to a fourth preselected unique color value when the second dimension is at its minimum value and the third dimension is at its maximum value;

the unique color values of the four corner points each being preselected so that the second and third dimensions are mapped to a color space wherein the second and third dimensions are defined by linear equations in respect of the constituent first and second sets of opposed chrominance values;

deriving first and second chromatic values representative of the color information as a function of the second and third dimensions and the four corner point color values;

utilizing the achromatic value and the first and second chromatic values to generate color value signals; and operating the color monitor as a function of the color value signals.

2. The method of claim 1 wherein the step of providing the achromatic dimension is performed by deriving a dimension based upon the brightness of red, green and blue color constituents of the color information.

3. The method of claim 2 wherein the step of providing the first and second chromatic dimensions is performed by deriving dimensions represented by sets of opposed red-green and blue-yellow constituents of the color information, respectively.

4. The method of claim 3 wherein the red, green and blue constituents of the color information are normalized to corresponding red, green and blue values at a preselected reference value of brightness and the first and second chromatic values are derived from normalized red-green and blue-yellow values, respectively.

5. The method of claim 4 comprising the further steps of deriving normalized red, green and blue values from the first and second chromatic values, and un-normalizing the normalized red, green and blue values to corresponding red, green and blue values at the brightness corresponding to the red, green and blue constituents of the color information.

6. The method of claim 1 comprising the further step of processing the color information by processing at least one of the achromatic value and the first and second chromatic values.

7. The method of claim 3 wherein:

the first preselected unique color value is chartreuse;

the second preselected unique color value is magenta;

the third preselected color value is orange; and the fourth preselected unique color value is cyan.

8. A method of controlling a color monitor, comprising the steps of:

providing a plurality of image elements, each of the image elements comprising red, green and blue constituent values (RGB), the image elements together defining an image to be displayed;

for each image element, providing an L value, an S value and a T value, wherein: the L value is defined as:

$$L=(\min(RGB)+\max(RGB)/2$$

and each of the S value and the T value is derived as a function of the red, green and blue constituent values by reference to an S-T plane wherein the S-T plane comprises:

an S axis having a minimum value at (RGB)=(0, 1, 0) and a maximum value at (RGB)=(1, 0, 0);

a T axis having a minimum value at (RGB)=(0, 1, 0) and a maximum value at (RGB)=(0, 0, 1);

a first corner point projected from the minimum value of each of the S axis and the T axis equal to (RGB)=( ½ , 1, 0);

a second corner point projected from the maximum value of each of the S axis and the T axis equal to (RGB)=(1, 0, 1);

a third corner point projected from the maximum value of the S axis and the minimum value of the T axis equal to (RGB) =(1, ½, 0);

a fourth corner point projected from the minimum value of the S axis and the maximum value of the T axis equal to (RGB) =(0, 1, 1);

so that S and T values for the image elements are defined by linear equations in respect of corresponding RGB values of the image elements;

utilizing the L, S and T values for each image element to generate color value signals; and operating the color monitor as a function of the color value signals for display of the image elements.

9. The method of claim 8 further comprising the step of processing the color information by modifying at least one of the L, S and T values for at least one of the image elements.

10. A method of controlling a color monitor, comprising the steps of:

providing a plurality of image elements, each of the image elements comprising red, green and blue constituent values (RGB), the image elements together defining an image to be displayed;

for each image element, providing a V value an S value and a T value, wherein: the V value is defined as:

V=max (RGB) and each of the S value and the T value is derived as a function of the red, green and blue constituent values by reference to an S-T plane wherein: the S-T plane comprises:

an S axis having a minimum value at (RGB)=(0, 1, 0) and a maximum value at (RGB)=(1, 0, 0);

a T axis having a minimum value at (RGB)=(1, 1, 0) and a maximum value at (RGB)=(0, 0, 1);

a first corner point projected from the minimum value of each of the S axis and the T axis equal to (RGB)=( ½ , 1, 0);

a second corner point projected from the maximum value of each of the S axis and the T axis equal to (RGB)=(1, 0, 1);

a third corner point projected from the maximum value of the S axis and the minimum value of the T axis equal to (RGB) =(1, ½, 0);

a fourth corner point projected from the minimum value of the S axis and the maximum value of the T axis equal to (RGB) =(0, 1, 1);

so that S and T values for the image elements are defined by linear equations in respect of corresponding RGB values of the image elements;

utilizing the V, S and T values for each image element to generate color value signals; and operating the color monitor as a function of the color value signals for display of the image elements.

11. The method of claim 10 further comprising the step of processing the color information by modifying at least one of the V, S and T values for at least one of the image elements.

12. A color information processing system, which comprises:

an input device adapted to receive red, green and blue constituent values (RGB) of a color;

a processing device coupled to the input device and adapted to convert the red, green and blue constituent values of the color to an achromatic value and first and second chromatic values wherein: each of the first and second chromatic values is derived as a function of the red, green and blue constituent values by reference to an S-T plane wherein: the S-T plane comprises an S axis having a minimum value at a first (RGB) value and a maximum value at a second (RGB) value;

a T axis having a minimum value at a third (RGB) value and a maximum value at a fourth (RGB) value;

a first corner point projected from the minimum value of each of the S axis and the T axis and being equal to a fifth (RGB) value;

a second corner point projected from the maximum value of each of the S axis and the T axis and being equal to a sixth (RGB) value;

a third corner point projected from the maximum value to the S axis and the minimum value of the T axis and being equal to a seventh (RGB) value;

a fourth corner point projected from the minimum value of the S axis and the maximum value of the T axis and being equal to an eighth (RGB) value each of the fifth to eighth (RGB) values being a unique color value preselected so that the first and second chromatic values are defined by linear equations in respect of the constituent RGB values of the color; and a color monitor coupled to the processing device;

the processing device operating to utilize the achromatic value and first and second chromatic values of the color to generate color value signals corresponding to the color for operation of the color monitor,

13. The color information processing system of claim wherein:

the first (RGB) value=(0,1,0);

the second (RGB) value=(1,0,0);

the third (RGB) value=(1,1,0);

the fourth (RGB) value=(0,0,1);

the fifth (RGB) value=(½,1,0);

the sixth (RGB) value=(1,0,1);

the seventh (RGB) value=(1,½,0); and the eighth (RGB) value=(0,1,1).

14. The color information processing system of claim 12 further comprising a storage device coupled to the processing device and adapted to receive and store the achromatic value and the first and second chromatic values of the color.

15. The color information processing system of claim 14 further comprising a color image processing device coupled to the storage device and adapted to receive and processes the achromatic value and the first and second chromatic values of the color and to store the processed values in the storage device.

16. The color information processing system of claim 15 further comprising a color information decoder coupled to storage device and adapted to receive the achromatic value and the first and second chromatic values of the color from the storage device and to convert the achromatic value and the first and second chromatic values into red, greed and blue constituent values of the color by reference to the ST plane.

* * * * *